US008632856B2

(12) United States Patent
Jing et al.

(10) Patent No.: US 8,632,856 B2
(45) Date of Patent: Jan. 21, 2014

(54) HIGHLY WATER REPELLENT FLUOROPOLYMER COATING

(75) Inventors: Naiyong Jing, Woodbury, MN (US); Lisa P. Chen, Saint Paul, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 1157 days.

(21) Appl. No.: 12/091,855

(22) PCT Filed: Dec. 20, 2006

(86) PCT No.: PCT/US2006/048636

§ 371 (c)(1), (2), (4) Date: Jul. 24, 2008

(87) PCT Pub. No.: WO2007/075803

PCT Pub. Date: Jul. 5, 2007

(65) Prior Publication Data

US 2009/0029177 A1 Jan. 29, 2009

Related U.S. Application Data

(60) Provisional application No. 60/752,527, filed on Dec. 21, 2005.

(51) Int. Cl.
*B05D 3/02* (2006.01)

(52) U.S. Cl.
USPC ..... 427/375; 524/84; 524/167; 524/173; 524/210; 524/356; 524/361; 524/364; 524/365; 524/379; 524/391; 524/520; 524/544; 524/545; 524/546; 525/199; 525/200

(58) Field of Classification Search
USPC ..... 524/84, 356, 544, 545, 546, 520; 525/199, 200; 427/375
See application file for complete search history.

(56) References Cited

U.S. PATENT DOCUMENTS

| | | | | |
|---|---|---|---|---|
| 3,354,022 | A | 11/1967 | Dettre et al. | |
| 4,000,356 | A | 12/1976 | Weisgerber et al. | |
| 4,262,072 | A | 4/1981 | Wendling et al. | |
| 4,400,487 | A * | 8/1983 | Stoneberg et al. | 525/199 |
| 4,506,054 | A * | 3/1985 | Vasta | 524/413 |
| 5,494,752 | A | 2/1996 | Shimizu et al. | |
| 6,027,852 | A | 2/2000 | Sasaki et al. | |
| 6,068,911 | A | 5/2000 | Shouji | |
| 6,117,555 | A | 9/2000 | Fujomori et al. | |
| 6,361,829 | B1 | 3/2002 | Chen et al. | |
| 6,365,250 | B2 * | 4/2002 | Shifman et al. | 428/36.8 |
| 6,417,280 | B2 | 7/2002 | Effenberger et al. | |
| 6,429,249 | B1 | 8/2002 | Chen et al. | |
| 6,444,741 | B1 | 9/2002 | Chen et al. | |
| 6,482,519 | B1 | 11/2002 | Schleifstein | |
| 6,495,624 | B1 | 12/2002 | Brown | |
| 6,641,767 | B2 | 11/2003 | Zhang et al. | |
| 6,720,360 | B1 | 4/2004 | Grootaert et al. | |
| 6,800,354 | B2 | 10/2004 | Baumann et al. | |
| 7,638,581 | B2 * | 12/2009 | Jing et al. | 525/199 |
| 2003/0013795 | A1 | 1/2003 | Nun et al. | |
| 2003/0044619 | A1 * | 3/2003 | Leech et al. | 428/421 |
| 2004/0241395 | A1 | 12/2004 | Jing et al. | |

FOREIGN PATENT DOCUMENTS

| | | |
|---|---|---|
| JP | 10-88061 | 4/1998 |
| JP | 10-278164 | 10/1998 |
| JP | 11-269426 | 10/1999 |
| JP | 2000-230140 | 8/2000 |
| WO | 01/68940 | 9/2001 |
| WO | WO 01/68940 | 9/2001 |

OTHER PUBLICATIONS

Schakenraad J M et al. Patency of small caliber, superhydrophobic ePTFE vascular grafts: A pilot study in the rabbit carotid artery. Cells Mater. 1992; 2(3):193-199.

Hozumi, A. et al., *Preparation of ultra water—repellent films by microwave plasma-enhanced CVD*, Thin Solid Films 303, pp. 222-225 (1997).

Kunugi, Y. et al., *Preparation of ultrahydrophobic electrodes and their electrochemical properties*, J. Electroanal. Chem. 353, pp. 209-215 (1993).

Miller, J.D. et al., *Effect of Roughness as Determined by Atomic Force Microscopy on the Wetting Properties of PTFE Films*, Polymer Engineering and Science, 36, 14, pp. 1849-1855 (Jul. 1996).

Ogawa, K. et al., *Development of a Transparent and Ultrahydrophobic Glass Plate*, Jpn. J. Appl. Phys., 32, 1614, (1993).

Onda, T. et al., *Super-Water-Repellent Fractal Surfaces*, Langmiur, 12, 9, pp. 2125-2127 (1996) *Super-Water-Repellent Fractal Surfaces*.

Shibuichi, S. et al., *Super water-repellent surfaces resulting from fractal structure*, J. Phys. Chem, 100, 19512 (1996).

Tadanaga, K. et al., *Formation Process of Super-Water-Repellent $Al_2O_3$ Coating Films with High Transparency by the Sol-Gel Method*, J Am. Ceram Soc., 80, 12, pp. 3213-3216 (1997).

Tadanaga, K. et al., *Super-Water-Repellent $Al_2O_3$ Coating Films with High Transparency*, J. Am. Ceram. Soc. 80, 4, pp. 1040-1042 (1997).

Veeramasuneni A. et al., *Hydrophobicity of Ion-plated PTFE coatings*, Progress in Organic Coatings, 31, pp. 265-270 (1997).

Wenzel, R. N., *Resistance of Solid Surfaces to Wetting by Water*, Ind. Eng Chem., 28, 8, pp. 988-994 (1936).

Wu, Y. et al., *Thin Films with Nanotextures for Transparent and Ultra Water-Repellent Coatings Produced from Trimethylmethoxysilane by Microwave Plasma CVD*, Chem. Vap, Deposition, 8, 2, pp. 47-50 (2002).

* cited by examiner

*Primary Examiner* — Nicole M Buie-Hatcher
(74) *Attorney, Agent, or Firm* — Jean A. Lown

(57) ABSTRACT

Highly water repellent coated articles may be made by applying to a substrate a coating having dispersed therein or sprinkled thereon partially or fully fluorinated polymer microparticles. The coating includes a partially fluorinated hexafluoropropylene copolymer binder in a nonfluorinated solvent that dissolves the binder and does not dissolve the microparticles. The coating is heated sufficiently to bond the microparticles to the binder but not so much as to cause the receding water contact angle for the coating to fall below 80°.

11 Claims, No Drawings

HIGHLY WATER REPELLENT FLUOROPOLYMER COATING

CROSS-REFERENCE TO RELATED APPLICATION

This application claims priority to U.S. Provisional Application No. 60/752,527 filed Dec. 21, 2005, the disclosure of which is incorporated by reference.

FIELD

This invention relates to water-repellent coatings.

BACKGROUND

Water-repellent coatings or articles are mentioned or disclosed in, for example, U.S. Pat. Nos. 3,354,022, 6,117,555, 6,495,624 B1, 6,641,767 B2 and 6,800,354 B2; U.S. Patent Application Publication Nos. US 2003/0013795 A1 and US 2004/0241395 A1; Japanese Published Patent Application Nos. JP 10-88061 and JP 11-269426; and in Wenzel, R. N., *Resistance of Solid Surfaces to Wetting by Water*, Ind. Eng Chem., 28, 8, pp. 988-94 (1936), Kunugi, Y. et al., *Preparation of ultrahydrophobic electrodes and their electrochemical properties*, J. Electroanal. Chem. 353, pp. 209-215 (1993), Ogawa, K. et al., *Development of a Transparent and Ultrahydrophobic Glass Plate*, Jpn. J. Appl. Phys., 32, 1614, (1993), Schakenraad, J. M. et al., Cells Mater. 2, 193-199 (1992), Miller, J. D. et al., *Effect of Roughness as Determined by Atomic Force Microscopy on the Wetting Properties of PTFE Films*, Polymer Engineering and Science, 36, 14, pp. 1849-55 (July, 1996), Onda, T. et al., *Super-Water-Repellent Fractal Surfaces*, Langmiur, 12, 9, pp. 2125-27 (1996), Shibuichi, S. et al., *Super water-repellent surfaces resulting from fractal structure*, J. Phys. Chem., 100, 19512 (1996), Hozumi, A. et al., *Preparation of ultra water-repellent films by microwave plasma-enhanced CVD*, Thin Solid Films 303, pp. 222-25 (1997), Tadanaga, K. et al., *Super-Water-Repellent $Al_2O_3$ Coating Films with High Transparency*, J. Am. Ceram. Soc. 80, 4, pp. 1040-42 (1997), Tadanaga, K. et al., *Formation Process of Super-Water-Repellent $Al_2O_3$ Coating Films with High Transparency by the Sol-Gel Method*, J. Am. Ceram Soc., 80, 12, pp. 3213-16 (1997), Veeramasuneni A. et al., *Hydrophobicity of Ion-plated PTFE coatings*, Progress in Organic Coatings, 31, pp. 265-270 (1997), and Wu, Y. et al., *Thin Films with Nanotextures for Transparent and Ultra Water-Repellent Coatings Produced from Trimethylmethoxysilane by Microwave Plasma CVD*, Chem. Vap, Deposition, 8, 2, pp. 47-50 (2002).

CROSS REFERENCE TO RELATED APPLICATIONS

This application is a national stage filing under 35 U.S.C. §371 of PCT/US2006/048636, filed Dec. 20, 2006, which claims priority to U.S. Provisional Application No. 60/752,527, filed Dec. 21, 2005, the disclosure of which is incorporated by reference in its/their entirety herein.

Various fluorinated materials are mentioned or disclosed in, for example, U.S. Pat. Nos. 6,361,829, 6,417,280 B2, 6,429,249 B1 and 6,444,741 B1.

SUMMARY OF THE INVENTION

Some of the water-repellent coatings in the above-mentioned references have inadequate durability, or are made using expensive fluorinated solvents, or require a complex series of manufacturing steps. It would be desirable to provide coatings that are more durable, or which employ less expensive solvents, or which are easier to make. The present invention provides in one aspect a method for making a coated article, which method comprises:

a) providing a substrate;

b) providing microparticles of a partially or fully fluorinated polymer and providing a binder of a partially fluorinated hexafluoropropylene copolymer soluble in one or more of butyl acetate, ethyl acetate, methanol, dimethylacetamide, dimethylformamide, dimethylsulfoxide, acetone, methyl ethyl ketone, sulfolane or tetrahydrofuran;

c) applying to at least a portion of the substrate a coating comprising the microparticles and a solution of the binder in a nonfluorinated solvent that dissolves the binder and does not dissolve the microparticles, wherein prior to applying the binder solution to the substrate the microparticles are dispersed in the binder solution, or after applying the binder solution to the substrate the microparticles are sprinkled or otherwise deposited on the applied binder; and d) heating the coating sufficiently to bond the microparticles to the binder but not so much as to cause the receding water contact angle for the coating to fall below 80°.

In a further aspect of the above-mentioned method the binder solution contains one or both of (1) a binder crosslinking agent or (2) a binder or microparticle adhesion promoter.

The invention provides in another aspect a coating composition comprising:

a) microparticles of partially or fully fluorinated polymer dispersed in:

b) a solution comprising:

i) a partially fluorinated hexafluoropropylene copolymer binder soluble in one or more of butyl acetate, ethyl acetate, methanol, dimethylacetamide, dimethylformamide, dimethylsuilfoxide, acetone, methyl ethyl ketone, sulfolane or tetrahydrofuran, ii) a nonfluorinated solvent that dissolves the binder, does not dissolve the microparticles, and will provide a dried binder film having a nominal thickness less than the average microparticle diameter.

In a further aspect the above-mentioned coating composition contains one or both of (1) a binder crosslinking agent or (2) a binder or microparticle adhesion promoter.

The invention provides in yet another aspect a coated article comprising a substrate having thereon a dried or hardened coating comprising:

a) a film of partially fluorinated hexafluoropropylene copolymer binder having a nominal film thickness and b) microparticles of partially or fully fluorinated polymer having an average diameter greater than the nominal film thickness wherein the coating has a receding water contact angle of at least 80°.

These and other aspects of the invention will be apparent from the accompanying drawing and this specification. In no event, however, should the above summaries be construed as limitations on the claimed subject matter, which subject matter is defined solely by the attached claims, as may be amended during prosecution.

DETAILED DESCRIPTION

The words "a", "an", and "the" are used interchangeably with "at least one" to mean one or more of the elements being described. By using words of orientation such as "atop", "on", "upperrnost", "underlying" and the like for the location of various elements in the disclosed coated articles, we refer to the relative position of an element with respect to a horizontally-disposed, upwardly-facing substrate. We do not intend that the disclosed articles should have any particular orientation in space during or after their manufacture.

The word "polymer" refers to polymers, copolymers (e.g., polymers formed or formable from two or more different monomers), oligomers and combinations thereof.

The phrase "microparticles" refers to particles having an average particle diameter of about 1 to about 1000 μm.

A variety of substrates may be coated using the disclosed method and coating compositions. Representative substrates include rigid materials such as glass, metals, plastics, ceramics, semiconductors and other rigid materials that will be familiar to those skilled in the art. Representative substrates also include flexible materials (e.g., transparent, translucent or opaque flexible films), such as cellulosic materials (e.g., paper, cardboard and cellulose triacetate or "TAC"); polyesters and copolyesters such as polyethylene terephthalate ("PET"), heat stabilized PET ("HSPET"), terephthalate copolyester ("coPET"), polyethylene naphthalate ("PEN"), naphthalate copolyesters ("coPEN") and polybutylene 2,6-naphthalate ("PBN"); polyolefins such as low-density polyethylene ("LDPE"), linear low-density polyethylene ("LLDPE"), high density polyethylene ("HDPE"), polypropylene ("PP") and cyclic olefin copolymers (e.g., metallocene-catalyzed cyclic olefin copolymers or "COCs"); acrylates and methacrylates such as polymethyl methacrylate ("PMMA"), ethylene ethyl acrylate ("EEA"), ethylene methyl acrylate ("EMA") and ethylene vinyl acrylate ("EVA"); styrenics such as polystyrene ("PS"), acrylonitrile-butadiene-styrene ("ABS"), styrene-acrylonitrile ("SAN"), styrene/maleic anhydride ("SMA") and poly α-methyl styrene; polyamides such as nylon 6 ("PA6"); polyamideimide ("PAI"); polyimide ("PI"); polyetherimide ("PEI"); polyphthalamide; polyvinyl chloride ("PVC"); polyoxymethylene ("POM"); polyvinylnaphthalene ("PVN"); polyetheretherketone ("PEEK"); polyaryletherketone ("PAEK"); fluoropolymers (e.g., copolymers of tetrafluoroethylene and hexafluoropropylene; copolymers of tetrafluoroethylene and perfluoro(propoxy vinyl ether); terpolymers of hexafluoropropylene, tetrafluoroethylene, and ethylene; and terpolymers of tetrafluoroethylene, hexafluoropropylene and vinylidene fluoride); polycarbonates such as polycarbonate of bisphenol A ("PC"); polyarylate ("PAR"); polyphenylene oxide ("PPO"); sulfones such as polysulfone ("PSul"), polyarylsulfone ("PAS") and polyether sulfone ("PES"); and other materials that will be familiar to those skilled in the art. Flexible plastic substrates can if desired be uni-directionally oriented, biaxially oriented or heat-stabilized, using heat setting, annealing under tension or other techniques that will discourage shrinkage up to at least the heat stabilization temperature when the substrate is not constrained. The substrate can have any desired thickness. For applications involving flexible film substrates that are made or coated using roll-to-roll processing equipment, the substrate preferably has a thickness of about 0.005 to about 1 mm, more preferably about 0.025 to about 0.25 mm.

A variety of partially or fully fluorinated polymer microparticles may be employed in the disclosed method and coating compositions. As mentioned above, the microparticles have an average particle diameter of about 1 to about 1000 μm, and may for example have an average particle diameter of about 1 to about 700 μm, about 1 to about 500 μm, about 1 to about 100 μm, about 1 to about 50 nm, or about 1 to about 25 μm. The microparticles may be in the form of agglomerates of submicron particles that in their agglomerated form have an average agglomerate diameter greater than one micrometer. Owing to their size, the microparticles typically will scatter or absorb light. Desirably the microparticles will not dissolve to the extent of more than 1 wt. %, at room temperature and standard pressure, in any of butyl acetate, ethyl acetate, methanol, dimethylacetamide, dimethylformamide, dimethylsulfoxide, acetone, methyl ethyl ketone, sulfolane and tetrahydrofuran. Exemplary partially or fully fluorinated polymers typically may have a high crystalline content (as indicated by a $T_m$ greater than about 150° C.) and a fluorine content greater than about 50 weight percent. For example, the fluoropolymer may have a $T_m$ between about 150° C. and about 375° C., between about 150° C. and about 320° C., between about 150° C. and about 300° C. or between about 170° C. and about 300° C. Also, the fluoropolymer may have a fluorine content between about 50 and about 76 weight percent, between about 60 and about 76 weight percent, or between about 65 and about 76 weight percent. Representative partially or fully fluorinated polymers are available from a variety of commercial sources. For example, "PTFE" (homopolymer of tetrafluoroethylene ("TFE")) microparticles such as DYNEON™ TFR™ 1105 PTFE, DYNEON TFM™ 1600 PTFE, DYNEON TF™ 1620 PTFE, DYNEON TF 1641 PTFE, DYNEON TF 1645 PTFE, DYNEON TFM 1700 PTFE, DYNEON TFM 1705 PTFE, DYNEON TF 1750 PTFE and DYNEON TF 9205 PTFE from Dyneon, LLC, and ZONYL™ MP 1000, ZONYL MP 1100, ZONYL MP 1150, ZONYL MP 1200, ZONYL MP 1300, ZONYL MP 1400, ZONYL MP 1500 and ZONYL MP 1600 from E.I. du Pont de Nemours & Co. may be used in the disclosed method and coating compositions. Other partially or fully fluorinated polymer microparticles that may be used include "THV" (copolymer of tetrafluoroethylene, hexafluoropropylene ("HFP") and vinylidene fluoride ("VDF")) microparticles such as DYNEON THV 415A Fluorothermoplastic agglomerates, DYNEON THV 500A Fluorothermoplastic agglomerates, DYNEON THV 610A Fluorothermoplastic agglomerates and DYNEON THV 815A Fluorothermoplastic agglomerates, all from Dyneon, LLC; "ETFE" (copolymer of TFE and ethylene) microparticles such as DYNEON Fluorothermoplastic ET X 6230A agglomerate from Dyneon, LLC; and "PFA" (copolymer of TFE and perfluoro(propoxy vinyl ether)) microparticles such as DYNEON Fluorothermoplastic PFA 6503A EPC, DYNEON Fluorothermoplastic PFA 6503 B EPC and DYNEON Fluorothermoplastic PFA 6503 C EPC, from Dyneon, LLC. Additional partially or fully fluorinated polymer microparticles that may be used include "FEP" (copolymer of TFE and hexafluoropropylene) and "HTE" (terpolymer of hexafluoropropylene, tetrafluoroethylene, and ethylene) microparticles such as the agglomerate form of DYNEON HTE X 1705 copolymer from Dyneon, Oakdale, Minn. Other suitable partially or fully fluorinated polymer microparticles are available from suppliers such as Asahi Glass, Ausimont, Daikin Industries and Hoechst and will be familiar to those skilled in the art. Mixtures of microparticles may be employed.

A variety of partially fluorinated hexafluoropropylene copolymer binders may be employed in the disclosed method and coating compositions. Desirably the binder will dissolve to the extent of at least 1 wt. %, at room temperature and standard pressure, in one or more of butyl acetate, ethyl acetate, methanol, dimethylacetamide, dimethylformamide, dimethylsulfoxide, acetone, methyl ethyl ketone, sulfolane and tetrahydrofuran. Exemplary binders include those having a combination of low crystalline content (as indicated by a $T_m$ less than about 150° C.) or an amorphous structure (as indicated by having no measurable crystalline melting point as determined using differential scanning calorimetry), together with a fluorine content greater than about 40 weight percent. For example, the binder may have a $T_m$ less than about 100° C., less than about 80° C., less than about 60° C., or may have no measurable crystalline melting point. Also, the binder may have a fluorine content between about 40 and about 76 weight percent, between about 50 and about 76 weight percent, between about 60 and about 76 weight percent, between about 65 and about 76 weight percent, or between about 65 and about 71 weight percent. Representative binders include, for example THV fluorothermoplastics (e.g., DYNEON THV 220G Fluorothermoplastic from Dyneon, LLC); KYNAR™ polyvinylidene fluorides (e.g., PVDF homopolymers, TFE/VDF copolymers or TFE/HFP copolymers such as KYNAR 500 homopolymer, KYNAR 761 homopolymer, KYNAR 2800 copolymer, KYNAR 2801 copolymer, KYNAR 7201 TFE/VDF copolymer and KYNAR 9301 VDF/HFP/TFE terpolymer from Arkema, Paris, France); FLUOREL fluoroelastomers (e.g., FLUOREL HFP/VDF copolymers and FLUOREL TFE/HFP/VDF terpolymers, commercially available from Dyneon, LLC); DYNEON fluoroelastomers (e.g., DYNEON FE-2145, DYNEON FT-2481, DYNEON FE-5530, DYNEON FE-5730 and DYNEON FE-5830 fluoroelastomers from Dyneon, LLC); NEOFLON™ poly(chlorotrifluoroethylene) elastomers from Daikin Industries; and amorphous fluoropolymers (e.g., CYTOP™ fluoropolymers from Asahi Glass, TEFLON AF 1600 and TEFLON AF 2400 fluoropolymers from E.I. du Pont de Nemours & Co.). Other suitable binders are available from suppliers such as Ausimont, Daikin Industries and Hoechst and will be familiar to those skilled in the art. Mixtures of binders may be employed. The binder may be made from a monomer mixture including one or more cure site monomers (e.g., monomers having a halogen cure site such as a chlorine, iodine or bromine cure site). Halogen cure sites can be introduced into the binder via the judicious use of halogenated chain transfer agents which provide reactive halogen endgroups. Exemplary chain transfer agents will be familiar to those skilled in the art and may be found, for example, in U.S. Pat. No. 4,000,356. In addition to or in place of a halogen-containing cure site monomer, the binder may be made from a monomer mixture including one or more other cure site monomers, e.g., nitrile-containing cure site monomers as described in U.S. Pat. No. 6,720,360.

The microparticles and binder may be combined in a variety of ratios. The disclosed coating compositions desirably will contain sufficient microparticles to provide a dried or hardened coating having a reduced water contact angle compared to a coating that does not include such microparticles, and sufficient binder so that the applied coating is smooth and continuous. For example, considering only the weight of microparticles and binder, exclusive of any solvent or other added materials, the disclosed coating compositions may contain about 5 to about 95 weight percent microparticles and about 95 to about 5 weight percent binder; about 10 to about 75 weight percent microparticles and about 90 to about 25 weight binder; about 10 to about 50 weight percent microparticles and about 90 to about 50 weight percent binder; or about 10 to about 30 weight percent microparticles and about 90 to about 70 weight percent binder.

A variety of solvents may be employed in the disclosed methods and coating compositions. Representative solvents include, for example, esters such as methyl acetate, ethyl acetate and butyl acetate; alcohols such as methanol and ethanol; amides such as dimethylacetamide and dimethylformamide; dimethylsulfoxide; ketones such as acetone, methyl ethyl ketone, methyl isobutyl ketone, methyl amyl ketone, cyclohexanone and N-methylpyrrolidinone; sulfolane; ethers such as tetrahydrofuran, 2-methyl tetrahydrofuran and methyl tetrahydrofurfuryl ether; cyclic esters such as delta-valerolactone and gamma-valerolactone; fluorinated solvents such as perfluoro-2-butyltetrahydrofuran and hydrofluoroethers; other materials that will dissolve the binder but not the microparticles; and mixtures thereof. The disclosed coating compositions may also contain other organic liquids that do not dissolve the binder, and may contain water, provided that such other organic liquids and water do not detract unduly from applying and drying or hardening the desired coating. For example, such other organic liquids or water may represent less than 30%, less than 10%, less than 5% or less than 1% of the disclosed coating compositions. When the microparticles are to be dispersed in the binder (rather than being sprinkled on the binder), the selected solvent desirably will provide a homogeneous dispersion of the microparticles at a desirably high loading level, with adequate storage stability and a lack of settling or agglomeration, and a coating viscosity sufficient to provide a smooth applied coating with adequate coverage and sufficient film thickness. When the microparticles are to be sprinkled or otherwise deposited on binder, there may be greater latitude in solvent selection. The applied coating thickness may be sufficiently thin so that the dried or hardened coating has a nominal thickness less than the average microparticle diameter. For some applications it may be desirable for the dried or hardened coating to have a much greater nominal thickness, e.g., a thickness greater than the average microparticle diameter, but desirably such coatings exhibit discernible surface roughness doe to the presence of the microparticles. Expressed on a numerical basis, the solvent amount may for example be about 20 to about 99.5 wt. percent, about 20 to about 90 wt. percent or about 20 to about 80 wt. percent of the coating composition.

The disclosed coating compositions may contain a variety of optional additional ingredients. Exemplary additional ingredients include binder crosslinking agents (e.g., polyolefins) and initiators (e.g., photoinitiators and thermal initiators), and microparticle or binder adhesion promoting agents (e.g., silanes). Exemplary crosslinking agents include, for example, poly(meth)acryl monomers including di(meth) acryl containing compounds such as 1,3-butylene glycol diacrylate, 1,4-butanediol diacrylate, 1,6-hexanediol diacrylate, 1,6-hexanediol monoacrylate monomethacrylate, ethylene glycol diacrylate, alkoxylated aliphatic diacrylate, alkoxylated cyclohexane dimethanol diacrylate, alkoxylated hexanediol diacrylate, alkoxylated neopentyl glycol diacrylate, caprolactone modified neopentylglycol hydroxypivalate diacrylate, caprolactone modified neopentylglycol hydroxypivalate diacrylate, cyclohexanedimethanol diacrylate, diethylene glycol diacrylate, dipropylene glycol diacrylate, ethoxylated (10) bisphenol A diacrylate, ethoxylated (3) bisphenol A diacrylate, ethoxylated (30) bisphenol A diacrylate, ethoxylated (4) bisphenol A diacrylate, hydroxypivalaldehyde modified trimethylolpropane diacrylate, neopentyl glycol diacrylate, polyethylene glycol (200) diacrylate, polyethylene glycol (400) diacrylate, polyethylene glycol (600) diacrylate, propoxylated neopentyl glycol diacrylate, tetraethylene glycol diacrylate, tricyclodecanedimethanol diacrylate, triethylene glycol diacrylate and tripropylene glycol diacrylate. Other suitable crosslinking agents include tri(meth) acryl containing compounds such as glycerol triacrylate, trimethylolpropane triacrylate, ethoxylated triacrylates (e.g., ethoxylated (3) trimethylolpropane triacrylate, ethoxylated (6) trimethylolpropane triacrylate, ethoxylated (9) trimethylolpropane triacrylate, ethoxylated (20) trimethylolpropane triacrylate), pentaerythritol triacrylate, propoxylated triacrylates (e.g., propoxylated (3) glyceryl triacrylate, propoxylated (5.5) glyceryl triacrylate, propoxylated (3) trimethylolpropane triacrylate, propoxylated (6) trimethylolpropane triacrylate), trimethylolpropane triacrylate and tris(2-hydroxyethyl)isocyanurate triacrylate. Additional suitable crosslinking agents include higher functionality (meth)acryl containing compounds such as ditrimethylolpropane tetraacrylate, dipentaerythritol pentaacrylate, ethoxylated (4) pentaerythritol tetraacrylate and pentaerythritol tetraacrylate, caprolactone modified dipentaerythritol hexaacrylate; hydantoin moiety-containing poly(meth)acrylates, for example, as described in U.S. Pat. No. 4,262,072; and oligomeric (meth)acryl compounds such as, for example, urethane acrylates, polyester acrylates, epoxy acrylates; polyacrylamide analogues of the foregoing; and combinations thereof. Suitable crosslinking agents are widely available from vendors including Sartomer Company, Exton, Pa.; UCB Chemicals Corporation, Smyrna, Ga.; and Aldrich Chemical Company, Milwaukee, Wis. Exemplary commercially available crosslinking agents include SR-351 trimethylolpropane triacrylate ("TMPT-A") and SR-444 and SR 494 pentaerythritol tri/tetraacrylate ("PETA"), all from Sartomer Company. Mixtures of crosslinking agents and monofunctional materials (for example, mixtures of multifunctional and monofunctional (meth)acrylates, such as a mixture of TMPTA and methyl methacrylate), may also be employed. Other crosslinking agents or monofunctional materials that may be utilized in the disclosed coating compositions include fluorinated (meth)acrylates such as perfluoropolyether (meth)acrylates. These perfluoropolyether acrylates may desirably be based on multi-(meth)acrylate or mono-(meth)acrylate derivatives of hexafluoropropylene oxide ("HFPO") and may (in the case of the multi-(meth)acrylate derivatives) be used as a sole crosslinking agent. The multi-(meth)acrylate derivatives may also be used with nonfluorinated monofunctional (meth)acrylates such as methyl methacrylate, or with nonfluorinated crosslinking agents such as TMPTA or PETA, and the mono-(meth)acrylate derivatives may be used with nonfluorinated crosslinking agents such as TMPTA or PETA.

Exemplary initiators include free-radical photoinitiators such as benzophenone and its derivatives; benzoin, alpha-methylbenzoin, alpha-phenylbenzoin, alpha-allylbenzoin, alpha-benzylbenzoin; benzoin ethers such as benzil dimethyl ketal (e.g., IRGACURE™ 651, from Ciba Specialty Chemicals Corporation of Tarrytown, N.Y.), benzoin methyl ether, benzoin ethyl ether, benzoin n-butyl ether; acetophenone and its derivatives such as 2-hydroxy-2-methyl-1-phenyl-1-propanone (e.g., DAROCUR™ 1173, from Ciba Specialty Chemicals Corporation) and 1-hydroxycyclohexyl phenyl ketone (e.g., IRGACURE 184, from Ciba Specialty Chemicals Corporation); 2-methyl-1-[4-(methylthio)phenyl]-2-(4-morpholinyl)-1-propanone (e.g., IRGACURE 907, from Ciba Specialty Chemicals Corporation); 2-benzyl-2-(dimethylamino)-1-[4-(4-morpholinyl)phenyl]-1-butanone (e.g., IRGACURE 369, from Ciba Specialty Chemicals Corporation); aromatic ketones such as benzophenone and its derivatives and anthraquinone and its derivatives; benzildimethylketals (e.g., ESACURE™ KB-1, from Lamberti S.p.A of Gallarate, Spain; onium salts such as diazonium salts, iodonium salts, sulfonium salts; titanium complexes (e.g., CGI 784 DC, from Ciba Specialty Chemicals Corporation); halomethylnitrobenzenes; and mono- and bis-acylphosphines (e.g., IRGACURE 1700, IRGACURE 1800, IRGACURE 1850, IRGACURE 819, IRGACURE 2005, IRGACURE 2010, IRGACURE 2020 and DAROCUR 4265, all from Ciba Specialty Chemicals Corporation. Mixtures of photoinitiators may also be employed. Photosensitizers may also be used. For example, the photosensitizer 2-isopropyl thioxanthone from First Chemical Corporation, Pascagoula, Miss. may be used in conjunction with photoinitiators such as IRGACURE 369. Exemplary thermal initiators include azo, peroxide, persulfate and redox initiators, and mixtures thereof. If desired, mixtures of photoinitiators and thermal initiators may be employed. Initiators typically are used in a total amount less than about 10 weight percent, more typically less than about 5 weight percent, based on the total coating composition weight.

Exemplary adhesion promoting agents include photograftable silane esters containing olefinic functionality such as 3-(trimethoxysilyl)propyl methacrylate and vinyltrimethoxy silane. These photograftable silane esters may react with the binder to form a silyl-grafted material having pendent siloxy groups. Such siloxy groups may be available to form a bond with the microparticles, with adjacent coating layers or with the substrate thereby providing improved adhesion, improved coating durability or both improved adhesion and improved durability. Other exemplary adhesion promoting agents include amino-substituted organosilanes such as 3-aminopropyltrimethoxysilane and its oligomers (e.g., SILQUEST™ A-1110 from GE Silicones, Wilton, Conn.); 3-aminopropyltriethoxysilane and its oligomers (e.g., SILQUEST A-1100 and SILQUEST A-1106, from GE Silicones); 3-(2-aminoethyl)aminopropyltrimethoxysilane (e.g., SILQUEST A-1120 from GE Silicones); SILQUEST A-1130 from GE Silicones; (aminoethylaminomethyl)phenethyltrimethoxysilane; (aminoethylaminomethyl)phenethyltriethoxysilane; N-(2-aminoethyl)-3-aminopropylmethyldimethoxysilane (e.g., SILQUEST A-2120 from GE Silicones), bis-(7-triethoxysilylpropyl)amine (e.g., SILQUEST A-1170 from GE Silicones); N-(2-aminoethyl)-3-aminopropyltributoxysilane; 6-(aminohexylaminopropyl)trimethoxysilane; 4-aminobutyltrimethoxysilane; 4-aminobutyltriethoxysilane; p-(2-aminoethyl)phenyltrimethoxysilane; 3-aminopropyltris(methoxyethoxyethoxy)silane; 3-aminopropylmethyldiethoxysilane; oligomeric aminosilanes such as 3-(N-methylamino)propyltrimethoxysilane (e.g., DYNASYLAN™ 1146 from Sivento Silanes of Piscataway, N.J.); N-(2-aminoethyl)-3-aminopropylmethyldimethoxysilane; N-(2-aminoethyl)-3-aminopropylmethyldiethoxysilane; N-(2-aminoethyl)-3-aminopropyltrimethoxysilane; N-(2-aminoethyl)-3-aminopropyltriethoxysilane; 3-aminopropylmethyldiethoxysilane; 3-aminopropylmethyldimethoxysilane; 3-aminopropyldimethylmethoxysilane; 3-aminopropyldimethylethoxysilane; 4-aminophenyltrimethoxy silane; 3-phenylaminopropyltrimethoxy silane; 2,2-dimethoxy-1-aza-2-silacyclopentane-1-ethanamine; 2,2-diethoxy-1-aza-2-silacyclopentane-1-ethanamine; 2,2-diethoxy-1-aza-2-silacyclopentane; 2,2-dimethoxy-1-aza-2-silacyclopentane; tertiary amines such as N,N-dimethyl aniline and diazabicyclooctane; and bis-silyl ureas such as $((RO)_3Si(CH_2)NR)_2C{=}O$. Mixtures of adhesion promoting agents may be employed.

Those skilled in the art will appreciate that the disclosed coating compositions can contain other optional adjuvants, including surfactants, antistatic agents (e.g., conductive polymers), leveling agents, ultraviolet ("UV") absorbers, stabilizers, antioxidants, lubricants, pigments or other opacifiers, dyes, plasticizers, suspending agents and the like.

The disclosed coatings may be applied using a variety of techniques that will be familiar to those skilled in the art. Exemplary coating methods include die coating, knife coating, spray coating, curtain coating and dip coating. The coating composition may be applied in a continuous manner, e.g., by coating a moving web or other support or substrate to provide a roll, or long coated length, of coated article. The coating composition may instead or in addition be applied to individual or multiple separate substrate portions to provide, for example, one or more singly or multiply coated articles.

As mentioned above, the microparticles may be dispersed in the binder or sprinkled or otherwise deposited on the binder. Such deposition may take place on a wet applied binder coating or on a dried binder film. Suitable deposition methods will be familiar to those skilled in the art and include spray coating and drop coating.

Adhesion of the microparticles to the binder and retention of desired surface properties is aided by heating the applied coating. Sufficient heat should be employed to warm or soften the binder and bond the microparticles to the binder. By the phrase "heating the coating sufficiently to bond the microparticles to the binder" we mean that similarly-heated mating (e.g., pressed together) films formed from the microparticle polymer and the binder copolymer will exhibit after cooling at least about 5 kg/m T-Peel peel adhesion when evaluated according to ASTM D-1876. Care should be taken not to heat the coating excessively, e.g., care should be taken not to melt the microparticles. Desirably the coating exhibits discernible surface roughness due to the presence of projecting microparticles both before and after heating. Thus up to a point, increased heating can increase adhesion, but excessive heating may cause a loss of surface roughness and a loss or lowering of hydrophobicity. Desirably the coating is heated sufficiently so that a similarly-heated film formed from the microparticle polymer and binder copolymer will exhibit at least about 10 Kg/m or more, 100 Kg/m or more or 125 Kg/m or more T-Peel peel adhesion when evaluated according to ASTM D-1876, but not so much as to cause the exposed coating face water contact angle to fall below about 100°. Suitable heating techniques will be familiar to those skilled in the art, and include the use of energy sources such as hot air, infrared radiation, electron beam and visible or ultraviolet light. Use of such energy can also accelerate drying or hardening the applied coating.

The disclosed coatings may be used in a variety of applications that will be familiar to those skilled in the art. For example, the disclosed coatings may be applied to articles on which a hydrophobic surface, an oleophobic surface or a low friction surface may be desired. One exemplary use involves applying the disclosed coating to provide an ultrahydrophobic surface. Such a surface may have, for example, an advancing water contact angle of at least about 100°, at least about 120°, at least about 130°, at least about 140° or at least about 150°. Such a surface may also have a receding water contact angle of at least 80°, at least about 1000, at least about 110°, at least about 1200 or at least about 1300°. Representative surfaces include outdoor surfaces such as architectural surfaces, vehicle surfaces and signage.

The invention is further illustrated in the following illustrative examples, in which all parts, percentages and ratios are by weight unless otherwise indicated. Unless otherwise noted, all chemical reagents were or can be obtained from Sigma-Aldrich Corp., St. Louis, Mo. The following abbreviations are employed:

"MEK" refers to methyl ethyl ketone;

"THF" refers to tetrahydrofuran;

"PET" refers to poly(ethylene terephthalate) film having a nominal thickness of 0.23 millimeter (0.009 inch);

"THV 220" refers to DYNEON THV 220 G fluorothermoplastic, available from Dyneon, Oakdale, Minn.;

"THV 500" refers to DYNEON THV 500 A fluorothermoplastic, available from Dyneon, Oakdale, Minn.;

"THV 800" refers to DYNEON THV 815A fluorothermoplastic, available from Dyneon, Oakdale, Minn.;

"PFA" refers to DYNEON fluorothermoplastic PFA 6503, available from Dyneon, Oakdale, Minn.;

"HTE X 1705" refers to the agglomerate form of DYNEON HTE X 1705 copolymer, available from Dyneon, Oakdale, Minn.;

"PTFE 2071" refers to DYNEON TF 2071, a poly(tetrafluoroethylene) powder, available from Dyneon, Oakdale, Minn.;

"PTFE 9205" refers to DYNEON TF 9205, a poly(tetrafluoroethylene) powder, available from Dyneon, Oakdale, Minn.;

"FE-2145" refers to DYNEON FE-2145 fluoroelastomer, available from Dyneon, Oakdale, Minn.;

"PVDF" refers to SOLEF™ 11010 poly(vinylidene fluoride) available from Solvay Solexis, Inc., Thorofare, N.J.;

"KYNAR 761" refers to KYNAR 761 poly(vinylidene fluoride) available from Arkema, Paris, France;

"E15742" refers to DYNEON E15742, a peroxide curable fluoroelastomer, available from Dyneon, Oakdale, Minn.

Substrate Preparation

Various substrates (glass plates, nylon 12 films, BYNEL 3101 films and PET films) were primed by applying a 2% percent solution of 3-aminopropyltriethoxysilane in methanol and drying the coating in a forced air oven at 90° C. for approximately five minutes. The thus-primed substrates were allowed to cool to room temperature and the coatings were applied.

Coating Preparation (Coating Method A)

For each of the coating compositions of Examples 1-15, identified in Table 1, the binder was dissolved in MEK and was coated using a notched coating bar onto PET at a wet coating thickness of approximately 15 micrometers. The solvent was then allowed to evaporate at room temperature for approximately 15 minutes. Microparticles, identified in Table 1, were then sprinkled on the binder such that the binder surface was approximately 80% to 90% percent covered with the microparticles. Each sample was then dried in a forced air oven at a temperature and for a time as indicated in Table 1.

Coating Preparation (Coating Method B)

For each of the coating compositions of Examples 16-122, identified below, the microparticles were combined with a solution of the binder in an organic solvent and the resultant mixture was coated using a notched coating bar onto PET at a wet coating thickness of approximately 15 micrometers. The coating was then dried in a forced air oven at a temperature and for at time as indicated in Tables 2-9.

Determination of Left and Left Receding Water Contact Angles

Left and left receding water contact angles were measured using a Model 2500XE video contact angle system (available from AST Products, Inc., Billerica, Mass.). In each of Tables 1-9 below, "LCA" means the left water contact angle, and "LRA" means the left receding water contact angle.

Determination of T-Peel Adhesion

Films having dimensions of 6.35 centimeters (2.5 inches) long by 2.54 centimeters (1 inch) wide by 0.46 millimeters (0.018 inch) thick were formed from each of the microparticle polymer and binder copolymer and placed adjacent one another. To assist in later T-Peel testing, a strip of TFE coated fiber sheet was inserted along one short edge between the two films to a depth of about 6 millimeters (0.24 inch). The resulting assembly was heated under a pressure of approximately 6.89 kPa (approximatelyl pound per square inch) for 5 or 10 minutes at various platen temperatures in a WABASH™ hydraulic press from Wabash MPI, Wabash, Ind., then promptly transferred to a cold press and allowed to cool to room temperature under a pressure of approximately 6.89 KPa (approximately 1 pound per square inch). The TFE sheet was removed and the unbonded portions of the films were clamped in the jaws of an INSTRON™ Model 1125 tester from Instron Corp., Canton, Mass., equipped with a SINTECH™ Tester 20 from MTS Systems Corp., Eden Prairie, Minn. and operated at a 10.16 cm/min cross-head speed. T-Peel strength was calculated as the average load measured during the T-Peel test using at least two samples. Further details regarding the T-Peel test are set out in ASTM D-1876 ("Standard Test Method for Peel Resistance of Adhesives").

EXAMPLES 1-15

Coatings were prepared using Coating Method A, described above. The drying conditions (time and temperature), binder, microparticles (and weight ratio where a mixture of microparticles was employed), and the left and left receding water contact angles are shown below in Table 1.

TABLE 1

Data for Examples 1-15

| Example | Drying Time | Drying Temperature | Binder | Microparticles | LCA | LRA |
|---|---|---|---|---|---|---|
| 1 | 10 min | 160° C. | THV 220 | 1:1 THV 500 + PTFE | 152° | 152° |
| 2 | 10 min | 160° C. | THV 220 | 1:1 THV 500 + PFA | 152° | 149° |
| 3 | 10 min | 160° C. | THV 220 | 1:1 THV 500 + HTE X 1705 | 154° | 154° |
| 4 | 10 min | 200° C. | THV 220 | 1:1 THV 800 + PTFE | 150° | 150° |
| 5 | 10 min | 200° C. | THV 220 | 1:1 THV 800 + PFA | 153° | 152° |
| 6 | 10 min | 200° C. | THV 220 | 1:1 THV 800 + HTE X 1705 | 154° | 156° |
| 7 | 10 min | 160° C. | FE-2145 | 1:1 THV 500 + PTFE | 154° | 162° |
| 8 | 10 min | 160° C. | FE-2145 | 1:1 THV 500 + PFA | 149° | 140° |
| 9 | 10 min | 160° C. | FE-2145 | 1:1 THV 500 + HTE X 1705 | 149° | 154° |
| 10 | 10 min | 200° C. | FE-2145 | 1:1 THV 800 + PTFE | 159° | 158° |
| 11 | 10 min | 200° C. | FE-2145 | 1:1 THV 800 + PFA | 158° | 157° |
| 12 | 10 min | 200° C. | FE-2145 | 1:1 THV 800 + HTE X 1705 | 156° | 155° |
| 13 | 10 min | 200° C. | THV 220 | THE 1700p | 164° | 149° |
| 14 | 10 min | 200° C. | THV 220 | THV 500 | 146° | 149° |
| 15 | 10 min | 200° C. | THV 220 | 1:1 THV 500 + HTE X 1705 | 137° | 146° |

The coatings shown in Table 1 exhibited very high left and left receding contact angles. Control coatings of THV 200 prepared in essentially the same manner, but without the microparticles sprinkled on the coating, exhibit left and left receding contact angles of 101° and 78°, respectively.

EXAMPLES 16-46

Coatings Including THV Binder

Coatings were prepared using THV 220 fluorothermoplastic as the binder and Coating Method B, described above. The drying conditions (time and temperature), binder concentration and solvent, microparticles (and weight ratio where a mixture of microparticles was employed), microparticle loading level and the left and left receding water contact angles are shown below in Table 2. The notation "NM" means that a measurement was not made.

TABLE 2

Data for Examples 16-46

| Example | Drying Time | Drying Temperature | Binder Concentration (Solvent) | Microparticles | Microparticles Loading | LCA | LRA |
|---|---|---|---|---|---|---|---|
| 16 | 10 min | 140° C. | 4.2% (MEK) | THV 500 | 95% | 145° | 124° |
| 17 | 10 min | 140° C. | 4.2% (MEK) | THV 500 | 93% | 144° | 132° |
| 18 | 15 min | 140° C. | 7.0% (MEK) | THV 500 | 90% | 145° | 127° |
| 19 | 15 min | 140° C. | 8.0% (MEK) | THV 500 | 70% | 137° | 120° |
| 20 | 15 min | 140° C. | 8.0% (MEK) | THV 500 | 80% | 141° | 120° |

TABLE 2-continued

Data for Examples 16-46

| Example | Drying Time | Drying Temperature | Binder Concentration (Solvent) | Microparticles | Microparticles Loading | LCA | LRA |
|---|---|---|---|---|---|---|---|
| 21 | 10 min | 180° C. | 4.2% (MEK) | HTE X 1705 | 95% | 139° | 121° |
| 22 | 10 min | 180° C. | 4.2% (MEK) | HTE X 1705 | 93% | 141° | 124° |
| 23 | 20 min | 160° C. | 7.0% (THF) | HTE X 1705 | 90% | 143° | 120° |
| 24 | 15 min | 160° C. | 8.0% (MEK) | HTE X 1705 | 80% | 133° | 115° |
| 25 | 20 min | 160° C. | 10% (THF) | HTE X 1705 | 70% | 121° | 102° |
| 26 | 20 min | 160° C. | 10% (THF) | HTE X 1705 | 50% | 114° | 94° |
| 27 | 20 min | 160° C. | 7.0% (THF) | PTFE | 90% | 142° | 113° |
| 28 | 15 min | 160° C. | 8.0% (MEK) | PTFE | 80% | 141° | 123° |
| 29 | 15 min | 160° C. | 8.0% (MEK) | PTFE | 70% | 136° | 119° |
| 30 | 20 min | 160° C. | 10% (THF) | PTFE | 70% | 133° | 113° |
| 31 | 20 min | 160° C. | 10% (THF) | PTFE | 50% | 112° | 105° |
| 32 | 15 min | 160° C. | 8.0% (MEK) | THV 800 | 90% | 152° | 154° |
| 33 | 15 min | 160° C. | 8.0% (MEK) | THV 800 | 70% | 149° | 131° |
| 34 | 20 min | 160° C. | 7.0% (THF) | THV 800 | 90% | 151° | NM |
| 35 | 20 min | 160° C. | 10% (THF) | THV 800 | 50% | 105° | 90° |
| 36 | 10 min | 140° C. | 4.2% (MEK) | 4:1 THV 500 + PTFE | 95% | 145° | 133° |
| 37 | 10 min | 140° C. | 4.2% (MEK) | 4:1 THV 500 + PTFE | 93% | 147° | 133° |
| 38 | 10 min | 140° C. | 10% (MEK) | 4:1 THV 500 + PTFE | 70% | 131° | 109° |
| 39 | 20 min | 160° C. | 10% (THF) | 1:1 THV 500 + PTFE | 70% | 130° | 110° |
| 40 | 20 min | 160° C. | 10% (THF) | 1:1 THV 500 + THE 1700p | 70% | 130° | 105° |
| 41 | 20 min | 160° C. | 10% (THF) | 1:1 THV 500 + THV 800 | 70% | 128° | 116° |
| 42 | 20 min | 160° C. | 10% (THF) | 1:1 THV 800 + HTE X 1705 | 70% | 137° | 119° |
| 43 | 10 min | 170° C. | 4.2% (MEK) | 4:1 HTE X 1705 + PTFE | 95% | 145° | 130° |
| 44 | 10 min | 180° C. | 4.2% (MEK) | 4:1 HTE X 1705 + PTFE | 95% | 143° | 123° |
| 45 | 10 min | 180° C. | 4.2% (MEK) | 4:1 HTE X 1705 + PTFE | 93% | 143° | 128° |
| 46 | 20 min | 160° C. | 10% (THF) | 1:1:1 THV 500 + THV 800 + PTFE | 70 | 133° | 110° |

The coatings shown in Table 2 exhibited very high left and left receding contact angles. Increased microparticle loading levels correlated generally with increased contact angles.

EXAMPLES 47-60

Coatings Including FE-2145 Binder

Coatings were prepared using FE-2145 fluoroelastomer as the binder, THF as the solvent and Coating Method B. The drying conditions (time and temperature), binder concentration, microparticles (and weight ratio where a mixture of microparticles was employed), microparticle loading level and the left and left receding water contact angles are shown below in Table 3.

TABLE 3

Examples 47-60

| Example | Drying Time | Drying Temperature | Binder Concentration | Microparticles | Microparticle Loading | LCA | LRA |
|---|---|---|---|---|---|---|---|
| 47 | 20 min | 160° C. | 5% | THV 500 | 90% | 136° | 115° |
| 48 | 20 min | 160° C. | 10% | THV 500 | 70% | 133° | 111° |
| 49 | 20 min | 160° C. | 5% | THE 1700p | 90% | 143° | 123° |
| 50 | 20 min | 160° C. | 10% | THE 1700p | 88% | 144° | 132° |
| 51 | 20 min | 160° C. | 10% | THE 1700p | 70% | 134° | 119° |
| 52 | 20 min | 160° C. | 10% | PTFE | 88% | 149° | 146° |
| 53 | 20 min | 160° C. | 10% | PTFE | 70% | 148° | 138° |
| 54 | 20 min | 160° C. | 10% | THV 800 | 70% | 154° | 164° |
| 55 | 20 min | 160° C. | 10% | 1:1 THV 500 + PTFE | 70% | 139° | 122° |
| 56 | 20 min | 160° C. | 10% | 1:1 THV 500 + THE 1700p | 70% | 135° | 116° |
| 57 | 20 min | 160° C. | 10% | 1:1 THV 500 + THV 800 | 70% | 132° | 115° |
| 58 | 20 min | 160° C. | 10% | 1:1 THV 800 + HTE X 1705 | 70% | 140° | 117° |
| 59 | 20 min | 160° C. | 10% | 1:1:1 THV 500 + THV 800 + PTFE | 70% | 138° | 116° |
| 60 | 20 min | 160° C. | 10% | 1:1:1 THV 500 + THE 1700p + PTFE | 70% | 143° | 121° |

The coatings shown in Table 3 exhibited very high left and left receding contact angles. Increased microparticle loading levels correlated generally with increased contact angles.

EXAMPLES 61-68

Coatings Including PVDF Binder

Coatings were prepared using PVDF as the binder (at a 10 weight percent concentration), MEK as the solvent and Coating Method B. The drying conditions (time and temperature), microparticles, microparticle loading level and the left and left receding water contact angles are shown below in Table 4.

TABLE 4

| Examples 61-68 | | | | | | |
|---|---|---|---|---|---|---|
| Example | Drying Time | Drying Temperature | Microparticle | Microparticle Loading | LCA | LRA |
| 61 | 15 min | 150° | THV 800 | 70% | 153° | 148° |
| 62 | 15 min | 150° | THV 800 | 50% | 105° | 82° |
| 63 | 15 min | 150° | PTFE 9205 | 70% | 141° | 123° |
| 64 | 15 min | 150° | PTFE 9205 | 50% | 136° | 112° |
| 65 | 15 min | 150° | HTE X 1705 | 70% | 134° | 113° |
| 66 | 15 min | 150° | THV 500 | 70% | 142° | 120° |
| 67 | 15 min | 150° | PFA | 70% | 145° | 124° |

Most of the coatings shown in Table 4 exhibited very high left and left receding contact angles. Increased microparticle loading levels correlated generally with increased contact angles. The low microparticle loading level in Example 62 was believed to be responsible for the observed contact angles. Control coatings of PVDF prepared in essentially the same manner, but without the microparticles in the coating, exhibit left and left receding contact angles of 86° and 71°, respectively.

A coating of PVDF like that of Example 61 but employing PTFE 2071 microparticles exhibited left and left receding contact angles of 93° and 75°, respectively. PTFE 2071 microparticles have a relatively large average particle diameter (viz., about 500 μm), and adjustment of the microparticle size or microparticle loading in this formulation should increase the receding contact angle for the coating.

EXAMPLES 68-74

Coatings Including KYNAR 761 Binder

Coatings were prepared using KYNAR 761 poly(vinylidene fluoride) as the binder (at a 10% concentration), MEK as the solvent and Coating Method B. The drying conditions (time and temperature), microparticles, microparticle loading level and the left and left receding water contact angles are shown below in Table 5.

TABLE 5

| Examples 68-74 | | | | | | |
|---|---|---|---|---|---|---|
| Example | Drying Time | Drying Temperature | Microparticles | Microparticle Loading | LCA | LRA |
| 68 | 15 min | 150° C. | THV 800 | 70% | 144° | 128° |
| 69 | 15 min | 150° C. | THV 800 | 50% | 112° | 89° |
| 70 | 15 min | 150° C. | PTFE 9205 | 70% | 141° | 121° |
| 71 | 15 min | 150° C. | PTFE 9205 | 50% | 95° | 75° |
| 72 | 15 min | 150° C. | HTE X 1705 | 70% | 137° | 116° |
| 73 | 15 min | 150° C. | THV 500 | 70% | 128° | 102° |
| 74 | 15 min | 150° C. | PFA | 70% | 122° | 100° |

Most of the coatings shown in Table 5 exhibited very high left and left receding contact angles. Increased microparticle loading levels correlated generally with increased contact angles. The low microparticle loading levels in Examples 69 and 71 were believed to be responsible for the low observed contact angles. Control coatings of KYNAR 761 prepared in essentially the same manner, but without the microparticles in the coating, exhibit left and left receding contact angles of 88° and 72°, respectively.

EXAMPLES 75-82

Coatings Including THV 220 Binder

Coatings were prepared using THV 220 fluorothermoplastic as the binder (at a 10% concentration), MEK as the solvent and Coating Method B. The drying conditions (time and temperature), microparticles, microparticle loading level and the left and left receding water contact angles are shown below in Table 6.

TABLE 6

| Examples 75-82 | | | | | | |
|---|---|---|---|---|---|---|
| Example | Drying Time | Drying Temperature | Microparticles | Microparticle Loading | LCA | LRA |
| 75 | 10 min | 120° C. | THV 500 | 70% | 131° | 108° |
| 76 | 10 min | 140° C. | THV 500 | 70% | 133° | 110° |
| 77 | 10 min | 160° C. | THV 500 | 70% | 120° | 100° |
| 78 | 10 min | 180° C. | THV 500 | 70% | 117° | 95° |
| 79 | 10 min | 120° C. | HTE X 1705 | 70% | 133° | 108° |
| 80 | 10 min | 140° C. | HTE X 1705 | 70% | 130° | 100° |
| 81 | 10 min | 160° C. | HTE X 1705 | 70% | 119° | 99° |
| 82 | 10 min | 180° C. | HTE X 1705 | 70% | 128° | 109° |

The coatings shown in Table 6 exhibited very high left and left receding contact angles. Examples 75 through 78 illustrate that as the drying temperature is increased, the observed contact angles may increase and then decrease.

EXAMPLES 83-91

Coatings Including FE-2145 Binder

Coatings were prepared using FE-2145 fluoroelastomer as the binder (at a 10% concentration), MEK as the solvent and Coating Method B. The drying conditions (time and temperature), microparticles (and weight ratio where a mixture of microparticles was employed), microparticle loading level and the left and left receding water contact angles are shown below in Table 7.

TABLE 7

| Examples 83-91 | | | | | | |
|---|---|---|---|---|---|---|
| Example | Drying Time | Drying Temperature | Microparticles | Microparticle Loading | LCA | LRA |
| 83 | 10 min | 120° C. | THV 500 | 70% | 147° | 126° |
| 84 | 10 min | 140° C. | THV 500 | 70% | 142° | 123° |
| 85 | 10 min | 160° C. | THV 500 | 70% | 154° | 124° |
| 86 | 10 min | 180° C. | THV 500 | 70% | 118° | 98° |
| 87 | 10 min | 120° C. | HTE X 1705 | 70% | 146° | 131° |
| 88 | 10 min | 140° C. | HTE X 1705 | 70% | 146° | 130° |
| 89 | 10 min | 160° C. | HTE X 1705 | 70% | 143° | 125° |
| 90 | 10 min | 180° C. | HTE X 1705 | 70% | 146° | 128° |
| 91 | 10 min | 140° C. | 4:1 THV 500 + PTFE | 70% | 146° | 124° |

The coatings shown in Table 7 exhibited very high left and left receding contact angles. Examples 83 through 86 illustrate that as the drying temperature is increased, the observed contact angles may increase and then decrease.

EXAMPLES 92-112

Coatings Including Crosslinked FE-2145 Binder

Coatings were prepared using FE-2145 fluoroelastomer as the binder (at a 5-10% concentration), 1,12-diaminododecane as a crosslinking agent (at a 0.2% concentration), MEK as the solvent and Coating Method B. The drying conditions (time and temperature), binder concentration, microparticles, microparticle loading level and the left and left receding water contact angles are shown below in Table 8.

TABLE 8

Examples 92-112

| Example | Drying Time | Drying Temperature | Binder Concentration | Microparticles | Microparticle Loading | LCA | LRA |
|---|---|---|---|---|---|---|---|
| 92 | 15 min | 140° C. | 10% | PTFE | 70% | 152° | 142° |
| 93 | 15 min | 140° C. | 8.8% | PTFE | 80% | 149° | 141° |
| 94 | 15 min | 140° C. | 5% | PTFE | 90% | 151° | 150° |
| 95 | 10 min | 140° C. | 10% | PTFE | 50% | 139° | 121° |
| 96 | 10 min | 140° C. | 10% | PTFE | 70% | 150° | 141° |
| 97 | 10 min | 140° C. | 8% | PTFE | 95% | 152° | 153° |
| 98 | 15 min | 140° C. | 10% | HTE X 1705 | 70% | 150° | 131° |
| 99 | 15 min | 140° C. | 10% | HTE X 1705 | 80% | 148° | 132° |
| 100 | 15 min | 140° C. | 8% | HTE X 1705 | 90% | 149° | 132° |
| 101 | 10 min | 140° C. | 10% | HTE X 1705 | 50% | 145° | 129° |
| 102 | 10 min | 140° C. | 10% | HTE X 1705 | 70% | 147° | 130° |
| 103 | 10 min | 140° C. | 8% | HTE X 1705 | 95% | 150° | 144° |
| 104 | 15 min | 140° C. | 10% | PFA | 70% | 145° | 131° |
| 105 | 15 min | 140° C. | 10% | PFA | 80% | 150° | 137° |
| 106 | 15 min | 140° C. | 8% | PFA | 90% | 152° | 142° |
| 107 | 10 min | 140° C. | 10% | PFA | 50% | 140° | 120° |
| 108 | 10 min | 140° C. | 10% | PFA | 70% | 147° | 129° |
| 109 | 10 min | 140° C. | 8% | PFA | 95% | 153° | 146° |
| 110 | 10 min | 140° C. | 10% | THV 500 | 50% | 138° | 121° |
| 111 | 10 min | 140° C. | 10% | THV 500 | 70% | 146° | 130° |
| 112 | 10 min | 140° C. | 8% | THV 500 | 95% | 151° | 139° |

EXAMPLES 113-121

Coatings Including Crosslinked E15742

Coatings were prepared using E15742 fluoroelastomer as the binder (at an 8-10% concentration), triallyl triazine as a crosslinking agent (at a 2% concentration), di-t-butyl peroxide as an initiator (at a 2% concentration), MEK as the solvent and Coating Method B. The drying conditions (time and temperature), binder concentration, microparticles, microparticle loading level and the left and left receding water contact angles are shown below in Table 9. The occurrence of crosslinking was verified by immersing the dried films in excess MEK and verifying that the film remained undissolved after standing overnight.

TABLE 9

Examples 113-121

| Example | Drying Time | Drying Temperature | Binder Concentration | Microparticles | Microparticle Loading | LCA | LRA |
|---|---|---|---|---|---|---|---|
| 113 | 15 min | 160° C. | 10% | THV 500 | 50% | 112° | 88° |
| 114 | 15 min | 160° C. | 10% | THV 500 | 70% | 135° | 116° |
| 115 | 15 min | 160° C. | 8% | THV 500 | 95% | 140° | 123° |
| 116 | 15 min | 170° C. | 10% | HTE X 1705 | 50% | 116° | 94° |
| 117 | 15 min | 170° C. | 10% | HTE X 1705 | 70% | 132° | 113° |
| 118 | 15 min | 170° C. | 8% | HTE X 1705 | 95% | 143° | 124° |
| 119 | 15 min | 170° C. | 10% | PTFE | 50% | 120° | 100° |
| 120 | 15 min | 170° C. | 10% | PTFE | 70% | 134° | 116° |
| 121 | 15 min | 170° C. | 8% | PTFE | 95% | 144° | 126° |

EXAMPLES 122-129

Back-To-Back Laminate Peel Strengths

Laminated films of various microparticle polymers and binder copolymers were prepared and evaluated for T-Peel adhesion using the "Determination of T-Peel Adhesion" procedure set out above and a variety of heating times and temperatures. The binder polymer, microparticle polymer, lamination time, lamination temperature and observed average t-Peel adhesion are shown below in Table 10:

TABLE 10

Examples 122-129

| Example | Laminate (Binder Copolymer + Microparticle Polymer) | Lamination Time | Lamination Temperature | Peel strength (kg/m) |
|---|---|---|---|---|
| 122 | FE-2145 + THV 500 | 10 min | 120° C. | 17.86 |
| 123 | FE-2145 + THV 500 | 10 min | 160° C. | >53.57 |
| 124 | FE-2145 + THV 800 | 10 min | 160° C. | 8.93 |
| 125 | FE-2145 + THV 800 | 5 min | 200° C. | 8.93 |
| 126 | THV 200 + HTE X 1705 | 10 min | 120° C. | 8.93 |
| 127 | THV 200 + HTE X 1705 | 10 min | 160° C. | 125.00 |

TABLE 10-continued

Examples 122-129

| Example | Laminate (Binder Copolymer + Microparticle Polymer) | Lamination Time | Lamination Temperature | Peel strength (kg/m) |
|---|---|---|---|---|
| 128 | THV 200 + THV 500 | 10 min | 160° C. | 142.86 |
| 129 | THV 200 + THV 500 | 5 min | 200° C. | 151.79 |

The results in Table 10 show that increased heating can increase microparticle/binder adhesion.

COMPARATIVE EXAMPLE

Working Example 1 in Japanese Published Patent Application No. JP 11-269426 was replicated by dispersing 100 parts FE-2145 fluoroelastomer, 100 parts PTFE 9205 particles and 10 parts No. 09602 MP Polyamide particles from MP Biomedicals in 1900 parts N-methylpyrrolidinone. The patent application did not identify the particular polymeric materials that were used, so commercially available polymers whose characteristics appeared to be reasonably suited to the metal seal coating application described in the patent application were employed. The patent application also did not identify the amount of N-methylpyrrolidinone that was used but did say that a 50 μm thick dried coating was prepared, so an N-methylpyrrolidinone amount and a coating gap sufficient to provide an estimated 50 μm thick dried coating were employed. The coating was dried by heating it for one hour at 120° C. followed by storage in a ventilated hood for two days at room temperature. The left contact angle was 113°. The left receding contact angle was difficult to measure because water adhered to the coating, but appeared to be less than about 40°.

The coating was next heated at 200° C. but not for the 50 hour period referred to in the Working Example. After only two hours at 200° C. the coating turned from white to brown and appeared to be undergoing decomposition. Heating was discontinued at that point to limit evolution of hydrogen fluoride.

We claim:

1. A method for making a coated article, which method comprises:

a) providing a substrate;

b) providing microparticles of a partially or fully fluorinated polymer and providing a partially fluorinated binder soluble in one or more of butyl acetate, ethyl acetate, methanol, dimethylacetamide, dimethylformamide, dimethylsulfoxide, acetone, methyl ethyl ketone, sulfolane or tetrahydrofuran, wherein the partially fluorinated binder is a fluorothermoplastic comprising a terpolymer of tetrafluoroethylene, hexafluoropropylene, and vinylidene fluoride;

c) applying to at least a portion of the substrate a coating comprising the microparticles and a solution of the binder in a nonfluorinated solvent that dissolves the binder and does not dissolve the microparticles, wherein prior to applying the binder solution to the substrate the microparticles are dispersed in the binder solution, or after applying the binder solution to the substrate the microparticles are sprinkled or otherwise deposited on the applied binder; and d) heating the coating sufficiently to bond the microparticles to the binder but not so much as to cause the receding water contact angle for the coating to fall below 80°, wherein the coating comprises 70 to 95 weight percent microparticles based on a total weight of the microparticles plus the partially fluorinated binder.

2. A method according to claim 1 wherein the binder solution contains a binder or microparticle adhesion promoter.

3. A method according to claim 1 wherein the receding water contact angle for the coating does not fall below about 110°.

4. A method according to claim 1 wherein the receding water contact angle for the coating does not fall below about 120°.

5. A method according to claim 1 comprising heating the coating sufficiently so that similarly-heated mating films formed from the microparticle polymer and the binder copolymer will exhibit after cooling at least about 10 kg/m T-Peel peel adhesion when evaluated according to ASTM D-1876.

6. A method according to claim 1 comprising heating the coating sufficiently so that similarly-heated mating films formed from the microparticle polymer and the binder copolymer will exhibit after cooling at least about 100 kg/m T-Peel peel adhesion when evaluated according to ASTM D-1876.

7. A coating composition comprising:

a) microparticles of partially or fully fluorinated polymer dispersed in:

b) a solution comprising:

i) a partially fluorinated binder soluble in one or more of butyl acetate, ethyl acetate, methanol, dimethylacetamide, dimethylformamide, dimethylsulfoxide, acetone, methyl ethyl ketone, sulfolane or tetrahydrofuran, wherein the partially fluorinated binder is a fluorothermoplastic comprising a terpolymer of tetrafluoroethylene, hexafluoropropylene, and vinylidene fluoride, and ii) a nonfluorinated solvent that dissolves the binder, does not dissolve the microparticles, and will provide a dried binder film having a nominal thickness less than the average microparticle diameter, wherein the microparticles are present in a amount in a range of 70 to 95 percent based on a total weight of microparticles plus the partially fluorinated binder.

8. A coating composition according to claim 7 wherein the binder solution contains a binder or microparticle adhesion promoter.

9. A coating composition according to claim 7 wherein after drying or hardening the coating has at least about 5 kg/m back-to-back 180° peel adhesion and an exposed coating face receding water contact angle of at least about 110°.

10. A coating composition according to claim 7 wherein the microparticles comprise a homopolymer of tetrafluoroethylene; copolymer of tetrafluoroethylene, hexafluoropropylene and vinylidene fluoride; copolymer of tetrafluoroethylene and ethylene; copolymer of tetrafluoroethylene and hexafluoropropylene; copolymer of tetrafluoroethylene and perfluoro(propoxy vinyl ether); or terpolymer of hexafluoropropylene, tetrafluoroethylene, and ethylene.

11. A coating composition according to claim 7 wherein the partially fluorinated binder has a fluorine content of 65 to 76 weight percent.

* * * * *